United States Patent [19]

Schaeffer et al.

[11] 4,321,426

[45] Mar. 23, 1982

[54] BONDED TRANSPOSED TRANSFORMER WINDING CABLE STRANDS HAVING IMPROVED SHORT CIRCUIT WITHSTAND

[75] Inventors: Friedrich K. Schaeffer, Cheshire; Thomas F. Brennan, Dalton, both of Mass.

[73] Assignee: General Electric Company

[21] Appl. No.: 93,416

[22] Filed: Nov. 13, 1979

Related U.S. Application Data

[63] Continuation of Ser. No. 914,069, Jun. 9, 1978, abandoned.

[51] Int. Cl.[3] ..... H01B 11/02

[52] U.S. Cl. ..... 174/34; 174/DIG. 8; 310/213; 310/217; 336/186; 336/187

[58] Field of Search ..... 174/DIG. 8, 34; 310/213, 217; 336/186, 187

[56] References Cited

U.S. PATENT DOCUMENTS

| | | | |
|---|---|---|---|
| 3,011,082 | 11/1961 | Ahrens | 310/213 X |
| 3,033,727 | 5/1962 | Cram | 174/DIG. 8 |
| 3,048,651 | 8/1962 | Howard | 174/DIG. 8 |
| 3,283,280 | 11/1966 | Fischer | 174/34 |
| 3,297,970 | 1/1967 | Jones | 174/DIG. 8 |
| 3,702,499 | 11/1972 | Virsberg | 174/DIG. 8 X |

FOREIGN PATENT DOCUMENTS

| | | | |
|---|---|---|---|
| 867763 | 2/1960 | United Kingdom | 174/DIG. 8 |
| 1426617 | 3/1976 | United Kingdom | 174/DIG. 8 |

*Primary Examiner*—Richard R. Kucia
*Attorney, Agent, or Firm*—Robert A. Cahill

[57] ABSTRACT

A heat shrunken polymeric material is wrapped around a plurality of adhesive coated, insulated wire strands juxtaposed in a transposed configuration to compact the metal strands into intersurface contacting relation, and thus promote improved bonding together of the metal strands for enhanced short circuit withstand.

4 Claims, 8 Drawing Figures

BONDED TRANSPOSED TRANSFORMER WINDING CABLE STRANDS HAVING IMPROVED SHORT CIRCUIT WITHSTAND

This is a continuation, of application Ser. No. 914,069, filed June 9, 1978 now abandoned.

This abandoned application is also the parent of a continuation-in-part application Ser. No. 145,287, filed Apr. 30, 1980, and now issued as U.S. Pat. No. 4,276,102.

BACKGROUND OF THE INVENTION

Transposed cables are used in high power transformers for reducing the circulating currents that otherwise occur between electrical conductors in close proximity and in a side by side relationship. In order to cause the strands to adhere to each other for the purpose of resisting short circuit forces, which tend to cause the strands to separate, a layer of adhesive material is applied to each individual strand. Since the actual contact area held by the adhesive material represents approximately 10 percent of the available contact surface, added strand material is generally provided to insure resistance to the shear forces. The added strand material adds to the overall transformer cost since expensive copper alloys are required for good electrical conductivity, and further, since added transformer volume and dielectric coolants are required to contain the added copper material.

The purpose of this invention is to provide transformer winding cable of improved short circuit withstand having plural transposed cable strands compacted in a manner to achieve increased area of intersurface contact and thus promote improved adhesive bonding therebetween.

SUMMARY OF THE INVENTION

The invention comprises the addition of a heat shrinkable polymeric layer wrapped around a cable of adhesively coated transposed strands prior to heating the cable to melt the adhesive. The heat shrinking properties of the polymeric material are selected to lie between the temperature at which the adhesive melts and the temperature at which adhesive cure is initiated. The shrinking of the polymeric material while the adhesive is in a liquid condition causes a substantial increase in the contact area between the individual cable strands.

DESCRIPTION OF THE PREFERRED EMBODIMENT

Figure 1:
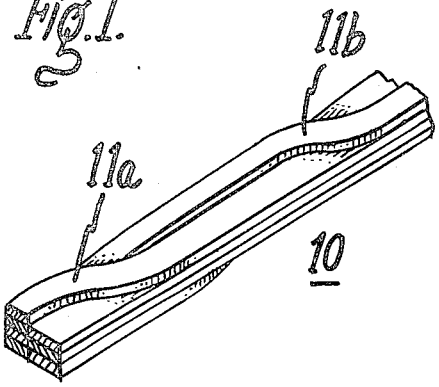
FIG. 1 is a side perspective view of a transposed cable for use with the method and materials of the invention.
Figure 2:
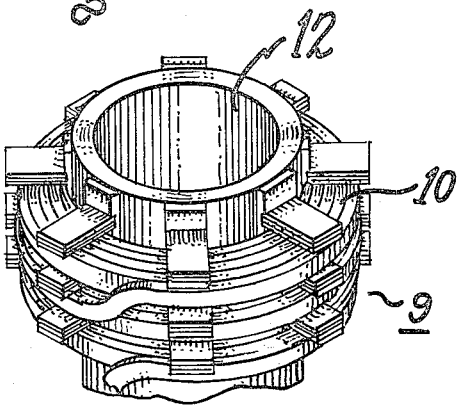
FIG. 2 is a top perspective view of a few layers of transposed cables around a winding cylinder for use within a power transformer.
Figure 3:
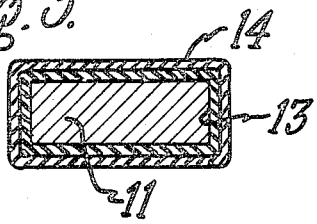
FIG. 3 is a cross section view of an adhesive coated cable strand for use within the cable of FIG. 1.
Figure 4:
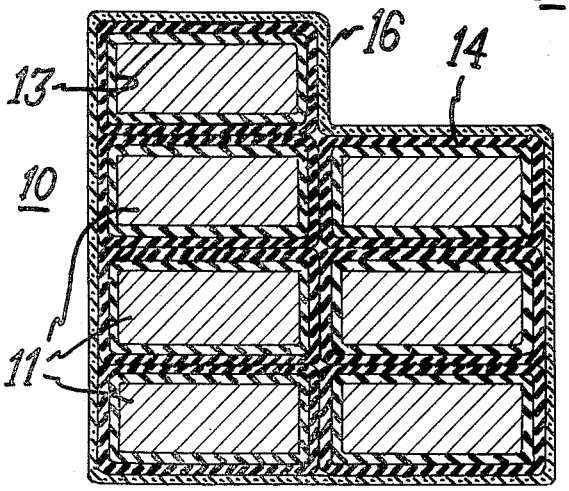
FIG. 4 is a cross section view of a transposed cable containing an insulating paper wrapping.

FIG. 1 contains a transposed cable 10 of the type wherein a plurality of wire strands are interposed in a transposed configuration for the purpose of reducing magnetic transaction between the individual strands. The configuration of FIG. 1 for example shows one strand 11*a* transposed relative to an adjoining strand 11*b* in an over-lapping transposed arrangement. In forming a transformer winding a plurality of transposed cables 10 are arranged around a winding cylinder 12, as shown in FIG. 2, to complete a transformer winding 9. As discussed earlier one of the problems involved in using transposed cables within transformer windings is the tendency of the individual strands to become separated under the intense shear forces to which the cables become subjected under transformer short circuit conditions. FIG. 3 shows an individual cable strand 11 containing a layer of insulating enamel 13 which is applied to the strand in order to electrically insulate the individual strands within the cable. An adhesive layer 14 is applied over the insulating enamel 13 in order to cause the individual strands to adhere to each other and to substantially increase the cable resistance to separation under the aforementioned shear force effects. A completed cable configuration 10 is shown in FIG. 4 wherein a plurality of individual strands 11 containing the adhesive coating 14 are wrapped with an outer layer of insulating paper 16 to provide insulation between the cable and other internal elements within a transformer casing.

When transformer windings are caused to fail under repeated subjection to short circuit shear forces the separated cable strands are found to adhere to each other at only scattered portions along the adjacent strand surface. It was discovered therefore that some means must be provided during the adhesive melting operation to force the individual strands into intimate contact in order to assure that the melted adhesive intermixes between the individual strands in its melted state and remains in intimate contact while the adhesive undergoes a thermosetting chemical reaction.

Figure 5:
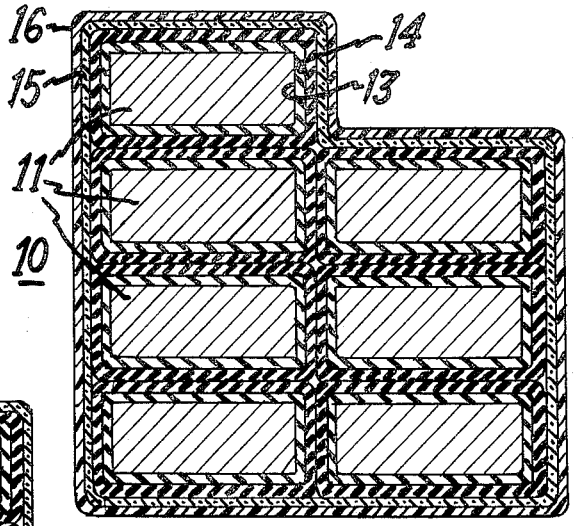
FIG. 5 is an enlarged cross section view of the transposed cable of FIG. 4 including a wrapping of a polymeric material.
Figure 6:
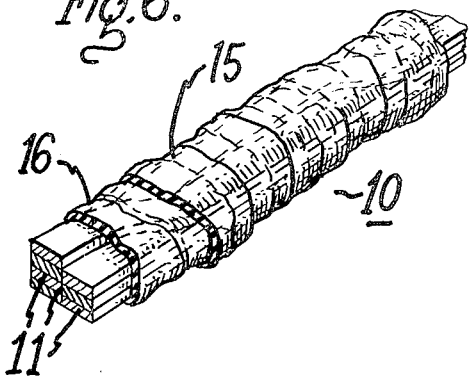
FIG. 6 is a top perspective view of the cable depicted in FIG. 5.

One means for providing compaction to the transposed cable during the adhesive melting operation is shown in FIG. 5 and consists in the application of a layer of Mylar film 15 around transposed cable 10 containing the usual adhesive coated strands 11. The Mylar material is selected to have a shrink initiation temperature of approximately 90° C. when the adhesive material comprises an epoxy having a melt temperature of approximately 70° C. The Mylar shrinks therefore while the epoxy is liquid and forces the individual strands into a tight compact arrangement and holds the individual strands in the tight configuration while the epoxy adhesive reacts. The epoxy material comprising the adhesive cures and holds the individual strands tenaciously against opposing shear forces when the Mylar wrapped cables are subject to short circuit tests. The Mylar material, which is a heat shrinkable polyester film, is selected for convenience of application since it is currently available in both sheet and tape form. It is to be clearly understood that other heat shrinkable polymeric materials can also be employed providing that the material is durable enough to hold the cables during the adhesive melting and thermosetting operations. The polyesters that are satisfactory for the purposes of the invention are thermoplastic synthetic resins not usually containing fatty acids or drying oils. Other thermoplastic heat shrinkable materials can be employed providing that the temperatures at which the thermoplastic materials shrink are selected lower than the adhesive cure temperature but higher than the adhesive melt point. The method for applying the Mylar film 15 of FIG. 5 is shown in FIG. 6 wherein the individual strands 11 formed in a transposed configuration are wrapped with a continuous winding layer of Mylar 15 wherein the strands are not completely covered. The gaps between the individual wraps of the Mylar film are necessary for outgassing during transformer drying and the subsequent impregnation with transformer oil. The occurrence of free gas at the surface can cause undesirably low corona excitation voltages during transformer test and operation. It is within the scope of the instant invention to employ heat shrinkable porous or micro-perforated heat shrinkable tapes whereby the substrate materials can readily become outgassed and oil impregnated through the polymeric material thereby allowing the use of the polymeric as primary insulation. Multiple wraps of the polymeric heat shrinkable material will result in further compaction with a resultant increase in bond area. It is further within the scope of the instant invention to use the wrapping of the heat shrinkable film as a substitute for the paper insulation shown for example in FIGS. 4 and 6 commonly employed with transposed cables. The excellent insulating properties of the polymeric film provides a function similar to the insulating paper while compacting and holding the individual strands in a tight intimate and close-knit configuration.

Figure 7:
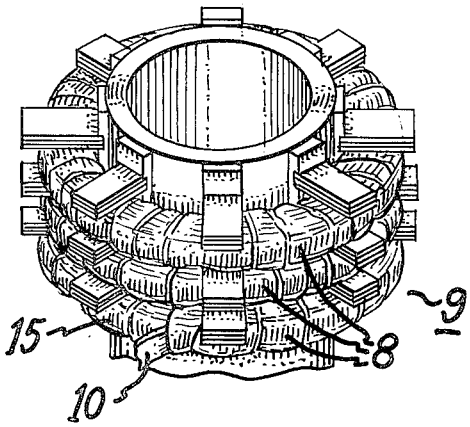
FIG. 7 is a top perspective view of the winding of FIG. 2 including a wrapping of polymeric material around the cable layers.

FIG. 7 shows a winding 9 comprising a plurality of layers of transposed cable 10 further including a wrapping of heat shrinkable film 15 around the individual layers 8. The wrapping of polymeric material 15 around the individual winding layers 8 in combination with the aforementioned winding of polymeric material around the transposed cable used within winding 9 provides a tighter more compact winding substantially increasing the overall shear resistance properties of the winding.

Figure 8:
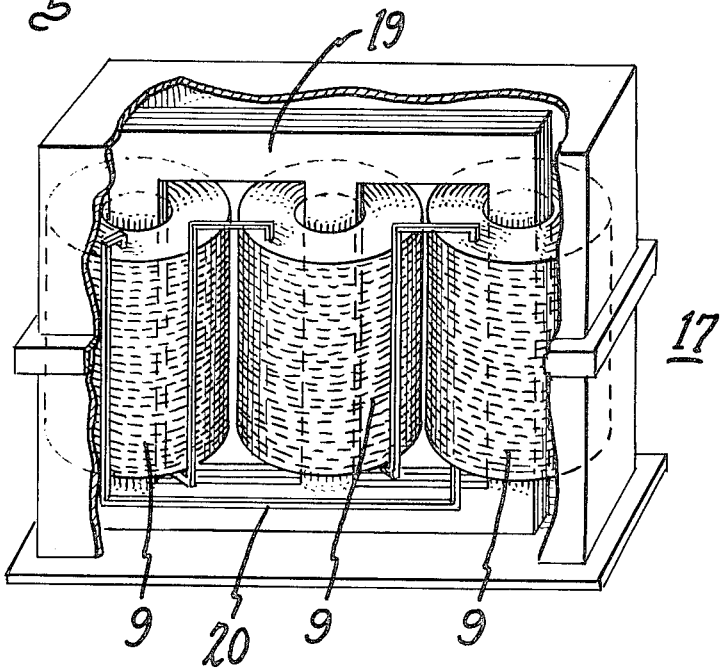
FIG. 8 is a top perspective view in partial section of a transformer containing windings of transposed cable according to the invention.

The substantial increases in shear resistance observed by the use of heat shrinkable polymeric films around transposed cable configurations reduces the amount of metal required for use within the cable strands and further reduces the interior volume of the transformer and the transformer overall weight. The decrease, for example, in the amount of wire employed in the transformer windings further decreases the quantity of dielectric oil used for cooling and insulating the transformer 17 of FIG. 8 of the type consisting of a metallic casing 18 and having a plurality of windings 9 concentrically arranged around the core 19. When transposed cables having the configuration depicted in FIG. 6 are used within the windings 9 of transformer 17, the windings are reduced in diameter to such an extent that the transformer casing 18 is correspondingly reduced and the volume of oil contained therein is reduced accordingly.

Although the described methods and materials for providing transposed cable configurations according to the invention have application within power transformer this is by way of example only. The transposed cable of the invention finds application wherever conductor bundles having high flexural strength properties may be required.

We claim:

1. A shear resisting cable for use in forming transformer windings comprising:

a plurality of metal strands of rectangular cross-section arranged juxtaposed each other in a transposed configuration;

a layer of insulating enamel overall coating the surface of each metal strand;

a layer of adhesive material having a predetermined melting temperature, said adhesive material layer overall coating the exposed insulating enamel surfaces of the metal strands to bond the juxtaposed insulating enamel surfaces together and thus maintain the transposed configuration of the metal strands in opposition to short circuit shear forces;

a layer of insulating paper wrapped about the bonded metal strands in transposed configuration; and a heat shrinkable tape having a shrink initiating temperature higher than the predetermined melting temperature of the adhesive material, the heat shrinkable tape wrapped about the insulating paper layer with adjacent wraps in spaced relation and being in a shrunken condition to promote the bonding together of the transposed metal strands by the adhesive material layer, the spaced relation of the tape wraps accommodating outgassing of said cable and the impregnation of said cable with transformer oil.

2. The cable of claim 1 wherein the heat shrinkable tape comprises a thermoplastic polyester resin.

3. The cable of claim 1 wherein the adhesive comprises an epoxy compound.

4. The cable of claim 1 wherein said shrink initiation temperature of the heat shrinkable tape is approximately 90° C. and said melting temperature of the adhesive material layer is approximately 70° C.

* * * * *